US007682097B2

(12) United States Patent
Knopow et al.

(10) Patent No.: US 7,682,097 B2
(45) Date of Patent: Mar. 23, 2010

(54) ALL-IN-ONE POLISH DISPENSER AND WIPER

(75) Inventors: Jeremy F. Knopow, Oak Creek, WI (US); Douglas P. Gundlach, Racine, WI (US)

(73) Assignee: S.C. Johnson & Son, Inc., Racine, WI (US)

( * ) Notice: Subject to any disclaimer, the term of this patent is extended or adjusted under 35 U.S.C. 154(b) by 1096 days.

(21) Appl. No.: 11/106,961

(22) Filed: Apr. 15, 2005

(65) Prior Publication Data

US 2006/0233592 A1 Oct. 19, 2006

(51) Int. Cl.
*A47L 1/08* (2006.01)

(52) U.S. Cl. ..... 401/136; 401/137; 401/138; 401/139; 401/188 R; 401/205

(58) Field of Classification Search ..... 401/136–139, 401/205, 207, 280, 281, 188 R
See application file for complete search history.

(56) References Cited

U.S. PATENT DOCUMENTS 1,310,290 A * 7/1919 Piechowicz ..... 401/136
1,343,490 A * 6/1920 Albertson ..... 137/625.47
1,461,708 A 7/1923 Marcello
2,147,769 A 2/1939 Epstein
2,377,837 A 6/1945 Zimmermann
3,324,855 A 6/1967 Heimlich
3,979,163 A 9/1976 Beard
4,078,865 A 3/1978 Moser
4,171,171 A 10/1979 Jones
4,225,254 A 9/1980 Holberg et al.
4,254,738 A 3/1981 Stanley
4,279,051 A * 7/1981 Malcolm ..... 15/29
4,557,619 A 12/1985 DeVincentis
4,618,279 A 10/1986 Gurevich et al.
4,776,716 A 10/1988 Huang
4,954,001 A 9/1990 Billat (Continued)

FOREIGN PATENT DOCUMENTS

FR 2735676 6/1995

(Continued)

OTHER PUBLICATIONS

3M Scotch-Brite Soap Dispensing Dishwand, Aug. 2, 2005, Internet Link http://www.3m.com/us/home_leisure/scotchbrite/products/handled_switchable.jhtml.

*Primary Examiner*—David J Walczak

(57) ABSTRACT

A device for applying a cleaning or polishing solution to a surface and wiping the solution over the surface includes a rotatable valve that allows for the dispensing of the solution through either a nozzle that sprays the solution in front of a disposable sponge-like pad secured to the device, or directly into the pad for application to the surface by the pad. The device also includes a rearward opening that releasably receives a container of the solution to be dispensed from the device. When the container is empty, the container is removed and replaced in order to allow the device to be used in a generally continuous manner for cleaning and polishing the surface. The disposable pad connected to the device may also include a cleaning surface capable of picking up dust, dirt and other debris in addition to applying the polishing and cleaning solutions to the surface.

22 Claims, 3 Drawing Sheets

U.S. PATENT DOCUMENTS

| | | | | | |
|---|---|---|---|---|---|
| D352,397 | S | | 11/1994 | Coleman | |
| 5,452,961 | A | | 9/1995 | Lu | |
| 5,536,095 | A | | 7/1996 | Diamond | |
| 5,702,194 | A | * | 12/1997 | Hsu | 401/136 |
| 5,846,011 | A | | 12/1998 | Bernstein et al. | |
| 5,918,995 | A | * | 7/1999 | Puurunen | 401/146 |
| 5,927,290 | A | | 7/1999 | Thiruppathi | |
| 5,934,296 | A | | 8/1999 | Clay | |
| 5,961,235 | A | | 10/1999 | Kennedy | |
| 6,010,268 | A | | 1/2000 | Sereg et al. | |
| 6,065,890 | A | * | 5/2000 | Weitz | 401/146 |
| 6,171,004 | B1 | | 1/2001 | Derhammer | |
| 6,425,701 | B1 | | 7/2002 | Jacobs | |
| 6,746,166 | B1 | | 6/2004 | Jeon et al. | |
| 6,805,682 | B1 | | 10/2004 | Campbell | |
| 6,817,801 | B1 | | 11/2004 | Colburn et al. | |

FOREIGN PATENT DOCUMENTS

| | | |
|---|---|---|
| FR | 2735676 | 12/1996 |
| GB | 2414654 | 7/2005 |

* cited by examiner

ALL-IN-ONE POLISH DISPENSER AND WIPER

FIELD OF THE INVENTION

The present invention relates to an apparatus for polishing and cleaning surfaces, and more specifically to a device capable of dispensing a polishing and cleaning composition and wiping the composition onto the surface simultaneously.

BACKGROUND OF THE INVENTION

Numerous devices have been developed over the years for dispensing a cleaning or polishing solution and simultaneously applying or wiping the solution off of the surface. The majority of these devices take the form of a mechanism that selectively dispenses an amount of a cleaning and/or polishing solution into a solution or fluid applying member when an actuator, such as an actuating button is pressed. The solution is dispensed directly into the solution applying member, e.g., a sponge, so that the solution disperses throughout the solution applying member for application to the surface.

However, on most occasions the cleaning solution is dispensed into the applying member approximately at the center of the applying member, meaning that a significant amount of the solution must be dispensed into the applying member for the solution to disperse to an applying edge or surface of the applying member. On many occasions, the amount of solution required to be dispensed into the applying member sufficiently to wet the applying member to enable the solution to be applied from the member to a surface is greater than the amount of solution that is applied to the surface. This can result in a situation where a large amount of solution that is utilized in wetting the applying member is wasted, as the solution normally evaporates out of the applying member when the device is not in use.

In order to overcome these shortcomings, other types of cleaning devices have been developed which are capable of spraying a desired amount of a cleaning solution onto the surface for further application to the surface by the applying member of the device. One such device is disclosed in U.S. Pat. No. 2,147,769 in which a spraying mechanism is located on the device to dispense a cleaning or polishing solution either through an opening in a polishing member, or in front of one side of the polishing member. In this manner, the amount of the solution dispensed is controlled in a manner such that the entire amount of solution that is dispensed is almost completely applied to the surface, without wasting any significant amount of the cleaning solution.

Other prior art devices have been also developed which incorporate both of the spraying and diffusion of mechanisms for applying the cleaning and/or polishing solution to a specified surface. For example, in U.S. Pat. No. 5,846,011, a bottle is disclosed including a sponge-like applying member disposed at a dispensing end of the bottle. The applying member is selectively connectable with a first fluid conduit leading into the bottle and through which a cleaning solution can be dispensed into the applying member for dispersion through the member and subsequent application to the surface. Alternatively, the dispensing end also includes a spray nozzle disposed adjacent the applying member that can be activated by retracting the dispensing end into the bottle and rotating the dispensing end to place the spray nozzle in fluid communication with a second fluid conduit.

However, these and other prior art devices for dispensing and applying a cleaning or polishing solution onto a surface have certain shortcomings that prevent the solution from being applied to a surface in a manner that allows for quick and easy application of the solution to the surface with a minimum usage of the solution in order to significantly reduce any wasting of the solution. Thus, it is desirable to develop a cleaning and polishing device that allows for the application of a cleaning or polishing solution to a surface in a manner that allows the solution to be easily applied to the surface with a minimum waste or evaporation of the solution. Also, it is desirable to be able to apply the solution and wipe the surface with only one hand, such that the individual can use the other hand to move objects on the surface, avoiding the cleaner getting onto the hands of the individual.

SUMMARY OF THE INVENTION

It is a primary object of the present invention to provide a cleaning device including a dispensing mechanism that allows for dispensing of a cleaning or polishing solution from the device either through or to one side of a solution applying member disposed on the device. The dispensing mechanism includes a rotatable valve capable of selectively enabling the solution to be dispensed from the device by the actuation of the mechanism through either a spray nozzle disposed on the device or through the dispersion of the solution through the applying member. The dispensed solution is provided from a solution reservoir or container that is releasably connectable to the device. The container enables the solution to be withdrawn as desired from the container through the use of the dispensing mechanism until the total amount of solution within the container is depleted, at which time the container can be easily disengaged from the device for disposal, and a full replacement container can be secured to the device for continued usage of the device.

According to another aspect of the present invention, the applying member is releasably engageable with a handle for the device such that the applying member can be replaced as it becomes progressively more soiled after a number of uses. The applying member is designed to enable the solution to be quickly and evenly dispersed from the dispensing mechanism through the applying member for even application of the solution to the surface. Further, the applying member can also include a movable outer member attached to the applying member opposite the handle that enhances the ability of the applying member in cleaning and polishing the surface on which the device is utilized.

According to still another aspect of the present invention, the device is provided with a simplified construction allowing for easy construction and assembly of the device, including the selective dispensing mechanism and the disposable solution applying member, to greatly reduce the time and cost associated with manufacturing and assembling the device.

Numerous other aspects, features and advantages of the present invention will be made apparent from the following detailed description taken together with the drawing figures.

BRIEF DESCRIPTION OF THE DRAWINGS

The drawings illustrate the best mode currently contemplated in practicing the present invention.

In the drawings.

DETAIL DESCRIPTION OF THE INVENTION

Figure 1:
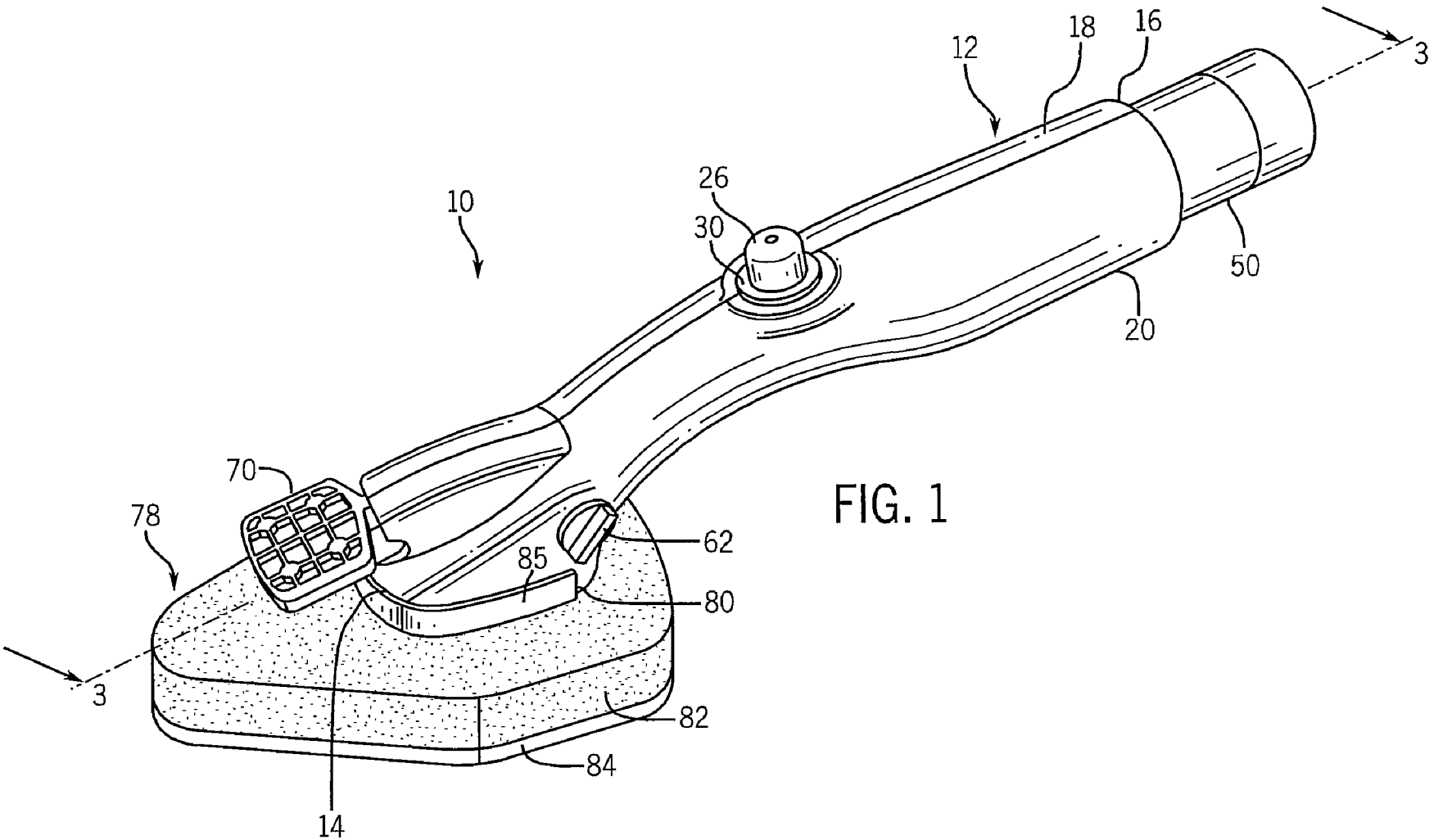
FIG. 1 is an isometric view of the polishing and cleaning device of the present invention.

With reference to the drawing figures in which like reference numerals designate like parts throughout the disclosure, the polishing and cleaning device constructed according to the present invention is indicated generally at 10 in FIG. 1. The device 10 includes a work member or handle 12 having a working or forward end 14 and a cartridge receiving or rearward end 16, and is formed of a pair of opposed halves or sections 18 and 20 connected to one another to form the handle 12. As described further below, the opposed halves 18 and 20 collectively define a hollow body containing additional components of the device. The sections 18 and 20 can be formed of any suitable material, but preferably are formed of a rigid, plastic material such that the sections 18 and 20 can be formed in any suitable plastic molding process. Further, the sections 18 and 20 can be joined to one another to form the handle 12 utilizing any suitable mechanical structures, such as pins 22 in section 18 that are fixedly received within bores 24 in section 20, any suitable heat-sealing means, or any suitable adhesive means, as well as any combination thereof. The handle 12, and sections 18 and 20, can also be formed to have a shape that is easily gripped by an individual, and may also include a separate high-friction coating or rubber (not shown) to improve the ease of use of the device 10.

Referring now to FIGS. 1-4, the handle 12 includes a depressible button or flexible bulb 26 that forms part of an actuator assembly or dispensing mechanism 28 disposed within the handle 12. However, in addition to the manually activated dispensing mechanism 28 using the button 26, other manually activated and mechanically activated dispensing mechanisms can also be employed in the device 10. The button 26 is disposed within a recess 30 formed between the opposed sections 18 and 20 of the handle 12 and is operatively connected to a pair of one-way valves 32 and 34 disposed immediately adjacent the button 26. The valve 32 allows fluid flow into the space between the button 26 and the valve 32 and is connected to a conduit 36, preferably formed of a flexible, plastic material that extends from the valve 32 rearwardly into connection with a solution inlet 38. The inlet 38 is disposed at an inner end 40 of a container housing 42 formed within the rearward end 16 of the handle 12. The depth of the housing 42 in the handle 12 is sufficient to enclose the majority of a solution container 50 to prevent the inadvertent disengagement of the container 50 from the handle 12 when the device 10 is in use. Further, while the housing 42 and container 50 are shown as being generally circular in cross-section, both the housing 42 and container 50 can have any desired shape. Also, the housing 42 may include one or more windows (not shown) disposed on the housing 42 to enable an individual to see the amount of cleaning or polishing solution 52 remaining within the container or cartridge 50.

An inner end 40 of the housing 42 includes a container engaging member 44 having a sleeve 46 formed therein but directly engages an outlet 48 of the solution container 50. The outlet 48 is releasably engaged within the sleeve 46 in a fluid-tight manner which allows a polishing or cleaning solution 52 held within the container 50 to be dispensed through the outlet 48 into the solution inlet 38. In preferred embodiments, this is accomplished by forming the outlet 48 with an open end directly engageable with the sleeve 46, or by forming a rupturable plenum (not shown) over the outlet 48 that can be punctured by the solution inlet 38 on engagement of the outlet 48 within the sleeve 46, among other suitable mechanisms, such as a one way valve that opens upon engagement with the container 50.

Once the solution 52 has been completely dispensed from the container 50, the outlet 48 is disengaged from the sleeve 46 such that the entire container 50 can be removed from within the container housing 42 for replacement with a full container 50.

The second-way valve 34 is also positioned in fluid communication with the button 26 spaced from the one-way valve 32 and allows for fluid flow from the space between the button 26 and valve 34 through the valve 34. Opposite the button 26, the valve 34 is connected to a flexible conduit 54, formed similarly to conduit 36, that extends towards the forward end 14 of the handle 12. The conduit 54 is engaged opposite the one-way valve 34 with an inlet 56 of a cylindrical housing 58. The housing 58 extends between the sections 18 and 20 of the handle 12 and holds a cylindrical, hollow rotatable valve 60 therein. The rotatable valve 60 is rotatable within the housing 58 by the operation of a handle 62 extending outwardly from the housing 58 and disposed on the exterior of the handle 12 adjacent section 20 that is engaged with the rotatable valve 60.

The inlet 56 disposed on the housing 58 is spaced ninety (90) degrees from each of a first outlet 64 and a second outlet 66 that are disposed on the housing 58 directly opposite one another. The first outlet 64 is connected to a conduit 68, formed of a flexible material similar to the conduits 36 and 54 described previously, that extends from the first valve outlet 64 to a spray nozzle 70 having nozzle openings 71 extending therethrough that is disposed on the exterior of the forward end 14 of the handle 12. The nozzle 70 can have any number of openings 71 and can also be movable to direct the solution 52 where desired. The nozzle 70 may also be adjustable to alter the form of the solution 52 being dispensed from the nozzle 70, such as between one or more streams or a fine mist.

The second outlet 66 is in fluid communication with a conduit 72, formed of a flexible material similar to conduits 36, 54 and 68, described previously, that is connected opposite the second outlet 66 to a fluid dispersion outlet 74. The rotatable valve 60 includes a pair of apertures 75 spaced ninety (90) degrees from one another. When the valve 60 is rotated using the handle 62, the apertures 75 can be moved between the configuration in FIG. 3, where the apertures 75 and valve 60 allow fluid to flow from the inlet 56 to the second outlet 66, and the configuration in FIG. 4, where the apertures 75 and valve 60 allow fluid to flow from the inlet 56 to the first outlet 64. As further shown in FIGS. 3 and 4, the conduits 36, 54, and 68 are disposed within a hollow portion of the handle 12.

The fluid dispersion outlet 74 extends generally downwardly from the handle 12 into a gap 76 formed between the handle 12 and a solution applying member 78. The solution applying member 78 is releasably attachable to the handle 12 and includes an attaching member 80 releasably securable to the handle 12, an absorbent member 82 secured to the attaching member 80, and a solution applying and cleaning member 84 attached to the absorbent member 82 opposite the attaching member 80.

The attaching member 80 can be formed of any suitable and easily releasable mechanism, such as a hook and loop mechanism, or a snap closing, among others. In a preferred embodiment, the attaching member 80 is formed of a generally rigid material, such as a plastic material, and includes an upwardly extending collar 86 secured to, or integrally formed at one end with a base 88, and having a number of inwardly extending tabs 90 spaced from the base 88. The tabs 90 are slidably and releasably engageable within a pair of notches 92 formed adjacent the forward end 14 of each section 18 and 20. The tabs 90 are biased into engagement with the notches 92 by the structure of the attaching member 80, which deflects outwardly when initially engaged with the handle 12 into the contact of the tabs 90 with the handle 12. As the attaching member 80 is moved further along the notches 92, the tabs 90 are then urged into each of the notches 92 due to the resiliency of the material forming the attaching member 80 to secure the tabs 90 within the notches 92, and the solution applying member 78 to the handle 12. The attaching member 80 also allows the solution applying member 78 to be removed from the forward end 14 of the handle 12 by urging the attaching member 80 away from the notches 92 in order to overcome the bias urging the tabs 90 into the notches 92 and slide the tabs 90 out of the aligned notches 92.

The base 88 is also formed with a rearwardly extending flange 94 that, when the attaching member 80 is engaged with the forward end 14 of the handle 12, is positioned immediately rearwardly of the forward end 14 to function as an additional securing mechanism for the attaching member 80. Furthermore, the base 88 also includes a central opening 96 that forms the gap 76 between the fluid dispersion outlet 74 and the solution applying member 78 when the attaching member 80 is engaged with the forward end 14 of the handle 12.

The absorbent member 82 secured to the attaching member 80 can be formed of any suitable, fluid-absorbent material, and preferably an open cell sponge material, such as various natural and synthetic sponge materials, including, but not limited to, cellulosic sponge material and polyurethane open celled foamed material. The material forming the absorbent member 82 is capable of retaining the solution 52 dispensed from the container 50 through the device 10 and applying the solution 52 to a surface (not shown) to be polished or cleaned utilizing the solution 52. The absorbent member 82 can be utilized alone, or in conjunction with a separate cleaning member 84 releasably attachable to a lower surface 85 of the absorbent member 82 opposite the attaching member 80. The cleaning member 84 is formed of a cloth-like material, such as a non-woven cloth, including, but not limited to, composite non-woven cloths formed of cellulosic fibers, rayon fibers, polypropylene fibers and polyester fibers, that is capable of absorbing the solution 52 dispensed from the container 50, and also capable of picking up dust, dirt or other debris on the surface on which the device 10 is being utilized. The cleaning member 84 is releasably securable to the absorbent member 82 by any suitable means, such as by a low-tack adhesive, or a hook and loop fastener, among others.

Figure 5:
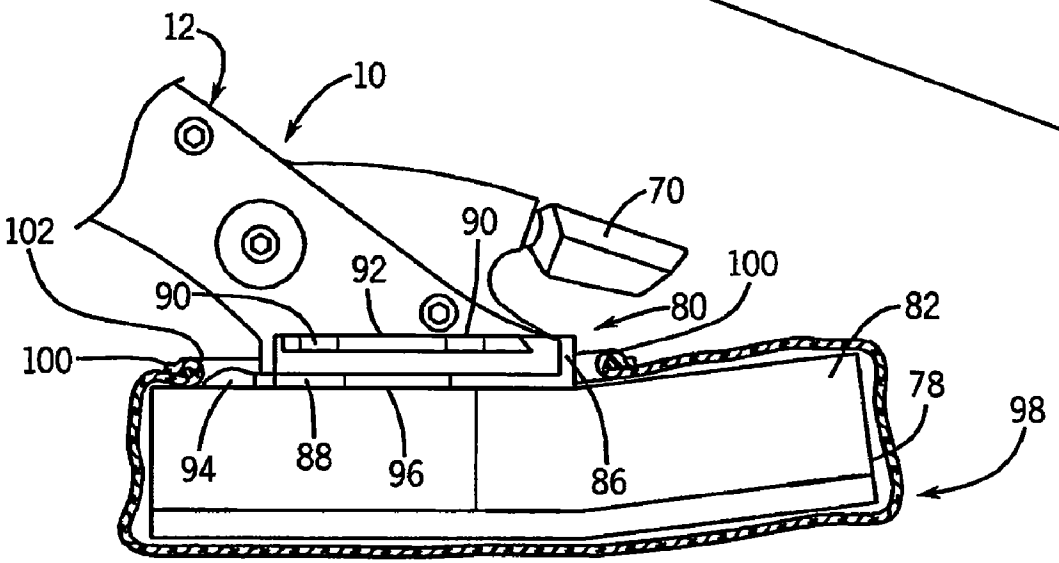
FIG. 5 is a partially broken-away side plan view of the device of FIG. 1 with an outer cleaning member disposed around the solution applying member.

Referring now to FIG. 5, in order to further assist the device 10 in picking up dust and other debris as well as polishing the surface, a secondary cleaning element 98 can be engaged with the solution applying member 78. The secondary element 98 can be formed of any suitable cleaning material, such as a mesh or cloth-like material, among others, and includes an endless elastic member 100 secured at one end to define an expandable opening 102 within which the solution applying member 78 can be positioned. The elastic member 100 can be expanded to increase the size of the opening 102 to such that the member 78 can be positioned therein, wherein the elastic member 100 is subsequently allowed to contract, thereby engaging the secondary element 98 with the solution applying member 78 around the attaching member 80. Also, the cleaning member 84 can be formed as the secondary element 98.

When utilizing the device 10 to clean and polish a surface, initially the container 50 including the solution 52 is engaged within the container housing 42 to provide a supply of the solution 52 to the device 10. Depending upon the particular mode of operation desired for the device 10, the valve 60 is rotated within the housing 58 to align the valve apertures 75 with the inlet 56 and either the first outlet 64 for dispensing the solution 52 through the openings 71 in nozzle 70 in front of the solution applying member 78, or with the second outlet 66 for dispensing the solution 52 onto the absorbent member 82. The button 26 is then initially depressed to create a vacuum within the button 26, and subsequently released to draw an amount of the solution 52 from the container 50 through the conduit 36 and one-way valve 32 into the button 26. A subsequent depressing of the button 26 urges the solution 52 contained in the button 26 through the one-way valve 34 and conduit 54 to the housing 58, while also drawing additional solution from the container 50 into the button 26. Depending on the position of the valve 60 within the housing 58, the solution 52 flows either to the nozzle 70 or to the dispersion outlet 74 for the desired manner of application of the solution 52 to the surface.

Figure 2:
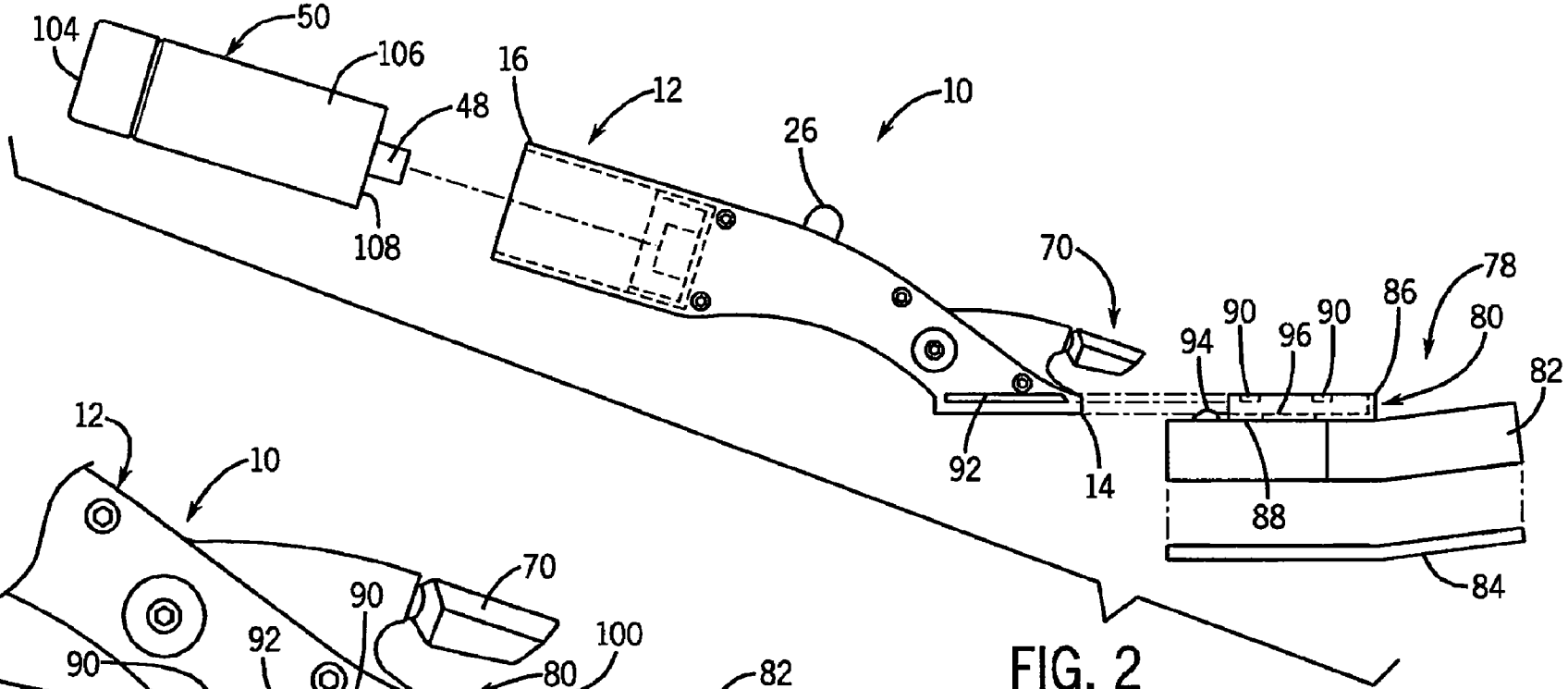
FIG. 2 an exploded side plan view of the device of FIG. 1.
Figure 3:
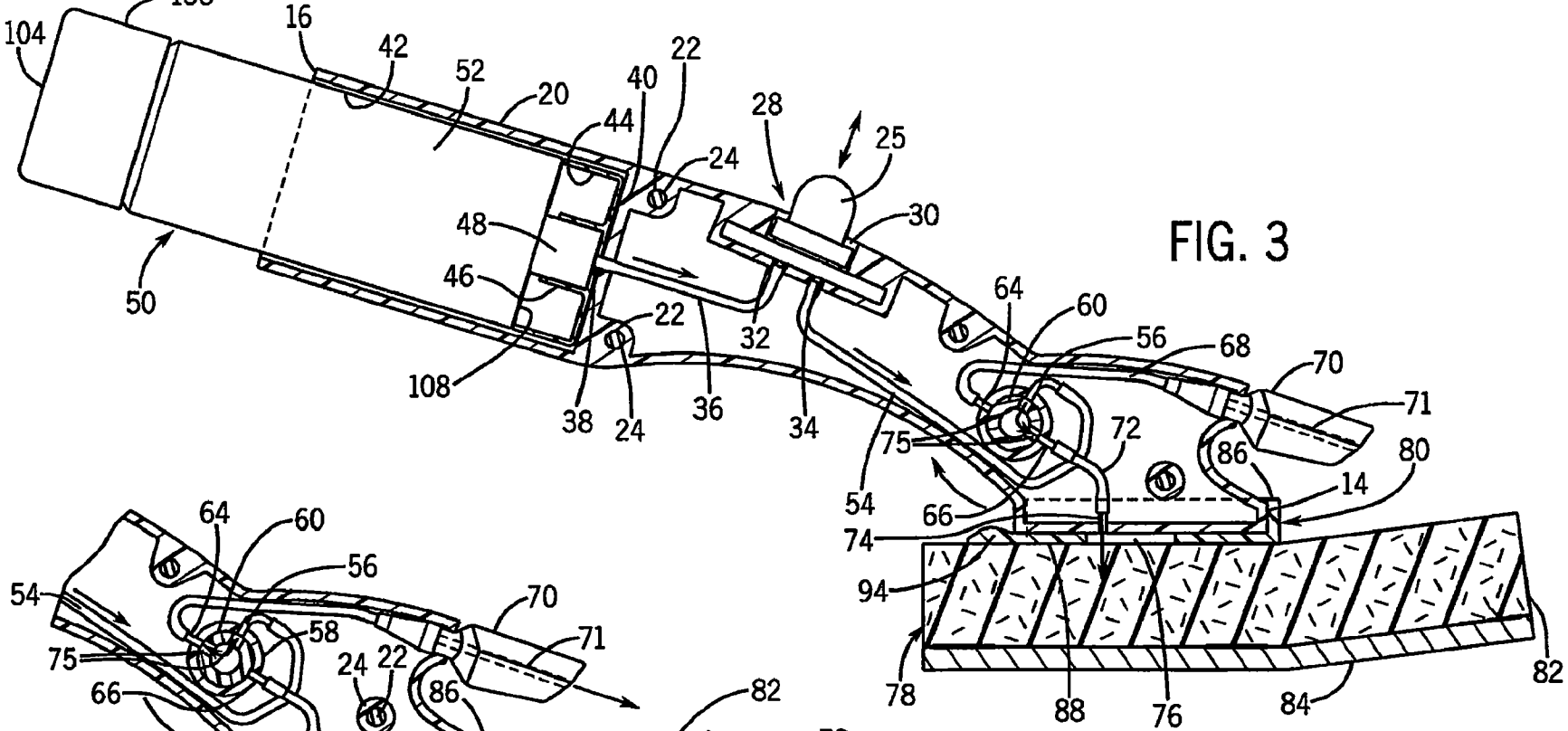
FIG. 3 is a cross-sectional view along line 3-3 of FIG. 1 showing a selective dispensing mechanism in a first configuration.
Figure 4:
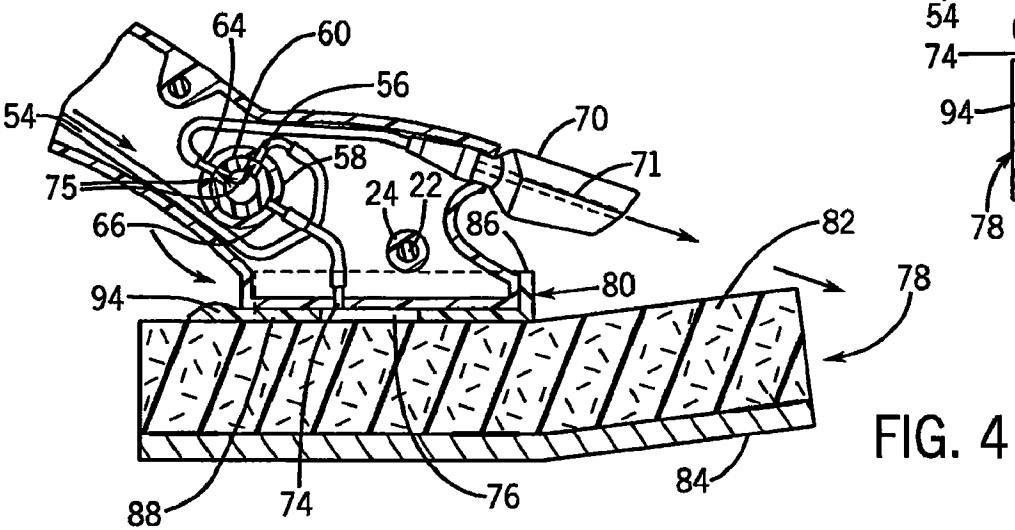
FIG. 4 is a partially broken-away cross-sectional view of the device of FIG. 3, with the selective dispensing mechanism in a second configuration.

Referring briefly back to FIGS. 2 and 3, it will be appreciated that the container 50 has an interior volume that is defined by a bottom 104, a generally cylindrical shaped wall 106 extending from the bottom 104, and a top 108 opposite the bottom 104 and connected to the wall 106. As further shown in FIG. 3, the solution outlet 48 is formed in the top 108 of the container 50.

Various alternatives are contemplated as being within the scope of the following claims particularly pointing out and distinctly claiming the subject matter regarded as the invention.

What is claimed is:

1. A hand-held device for applying a cleaning or polishing solution to a surface, a device comprising:

a) a handle configured to be loaded with a replaceable cartridge containing cleaning or polishing solution; and b) a dispensing mechanism disposed within the handle, the dispensing mechanism including a solution inlet adapted to be in fluid communication with the replaceable cartridge, a valve connected to the solution inlet, a first solution outlet in fluid communication with the valve, and a second solution outlet in fluid communication with the valve;

c) an actuator that is manually operative to allow solution to flow from the cartridge through the solution inlet to the valve; and d) first and second conduits in fluid communication with the actuator, wherein the first conduit is configured to pass solution from the solution inlet to the actuator and the second conduit is configured to pass solution from the actuator to the valve.

2. The device of claim 1 wherein the valve comprises:

a) a housing including a valve inlet, a first valve outlet and a second valve outlet; and b) a hollow member rotatably disposed within the housing and including a pair of apertures selectively alignable with the valve inlet and one of the first and second valve outlets.

3. The device of claim 2 wherein the housing includes a grippable portion extending outwardly from the handle.

4. A hand-held device for cleaning and polishing a surface, the device comprising:

a) a container having an interior volume defined by a bottom, at least one wall extending from the bottom, and a top opposite the bottom connected to the at least one wall, and a solution outlet formed in the top and in fluid communication with the interior volume, wherein the container is configured such that solution may only be loaded into the interior volume through the solution outlet;

b) a handle having a rearward end and a forward end and a hollow portion defined between the rearward end and the forward end and wherein the hollow portion is adapted to receive the container in a removable manner;

c) a dispensing mechanism disposed within the handle between the vessel and the forward end, the dispensing mechanism including a solution inlet adjacent the rearward end and in fluid communication with the solution outlet of the container, a rotatable valve connected to the solution inlet, a first solution outlet disposed adjacent the forward end and connected to the rotatable valve, and a second solution outlet disposed adjacent the forward end spaced from the first solution outlet and connected to the rotatable valve; and d) a solution application member secured to the forward end of the handle and in fluid communication with the first solution outlet.

5. The device of claim 4 wherein the solution application member comprises an absorbent member adapted to apply the solution to the surface.

6. The device of claim 5 wherein the first solution outlet is in fluid communication with the absorbent member.

7. The device of claim 5 further comprising a cleaning member secured to the absorbent member.

8. The device of claim 4 wherein the solution application member is releasably secured to the handle.

9. The device of claim 4 wherein the second solution outlet comprises a nozzle adapted to dispense the solution to one side of the solution application member.

10. The device of claim 4 wherein the solution inlet of the dispensing mechanism engages the solution outlet of the container when the container is loaded into the hollow portion of the handle.

11. The device of claim 4 wherein the dispensing mechanism includes a manual actuator connected between the solution inlet and the rotatable valve.

12. The device of claim 4 wherein the rotatable valve is manually actuated.

13. An apparatus for applying a solution to a work surface, comprising:

a work member having a generally hollow body defined by a cartridge receiving end and an work end, wherein the work end includes a nozzle outlet configured to provide a spray of the solution and an applicator pad configured to have at a portion that is dampened by the solution;

a valve movable between a first position and a second position, wherein the valve allows the delivery of solution to the nozzle outlet when in the first position and allows the delivery of solution to the applicator pad when in the second position;

an actuator assembly configured to allow the delivery of solution to the valve;

a first conduit extending within the hollow body from the cartridge receiving end to an inlet of the actuator assembly;

a second conduit extending from an outlet of the actuator assembly to an inlet of the valve;

a third conduit extending between a first outlet of the valve and the nozzle outlet;

a fourth conduit extending between a second outlet of the valve and the applicator pad; and a replaceable cartridge containing the solution and adapted to be loaded into the work member at the cartridge receiving end.

14. The apparatus of claim 13 wherein the solution includes one of a cleaning solution and a polishing solution.

15. The apparatus of claim 13 wherein the actuator assembly includes a flexible bulb that when depressed allows solution to flow from the first conduit to the second conduit.

16. The apparatus of claim 15 wherein the flexible bulb is seated in a recess formed in the work member.

17. The apparatus of claim 13 wherein the applicator pad is formed of fluid absorbent material.

18. The apparatus of claim 17 further comprising a cleaning member releasably attachable to a lower surface of the applicator pad.

19. The apparatus of claim 18 wherein the cleaning member is comprised of non-woven cloth.

20. The apparatus of claim 13 wherein the work member includes a hand-grippable protion.

21. The apparatus of claim 13 wherein the valve is configured to be manually rotated between the first position and the second position.

22. The apparatus of claim 13 constructed to allow one handed dispensing solution and application of the solution to a work surface.

* * * * *

UNITED STATES PATENT AND TRADEMARK OFFICE
Certificate

Patent No. 7,682,097 B2 Patented: March 23, 2010

On petition requesting issuance of a certificate for correction of inventorship pursuant to 35 U.S.C. 256, it has been found that the above identified patent, through error and without any deceptive intent, improperly sets forth the inventorship.

Accordingly, it is hereby certified that the correct inventorship of this patent is: Jeremy F. Knopow, Burlington, WI (US); Douglas P. Gundlach, Racine, WI (US); and Micah L. Maraia, Menomonie, WI (US).

Signed and Sealed this Third Day of May 2011.

GREGORY L. HUSON
*Supervisory Patent Examiner*
Art Unit 3751
Technology Center 3700